United States Patent [19]

Havel

[11] Patent Number: 4,845,481

[45] Date of Patent: Jul. 4, 1989

[54] CONTINUOUSLY VARIABLE COLOR DISPLAY DEVICE

[76] Inventor: Karel Havel, P.O. Box 66, Station M, Toronto, Ontario, Canada, M6S 4T2

[21] Appl. No.: 922,847

[22] Filed: Oct. 24, 1986

Related U.S. Application Data

[62] Division of Ser. No. 817,114, Jan. 8, 1986, Pat. No. 4,647,217.

[51] Int. Cl.[4] ..... G09G 3/14

[52] U.S. Cl. ..... 340/762; 340/701; 340/767; 340/815.1

[58] Field of Search ..... 340/701, 702, 703, 762, 340/756, 782, 793, 815.04, 815.1, 767

[56] References Cited

U.S. PATENT DOCUMENTS

| | | | |
|---|---|---|---|
| 3,740,570 | 6/1973 | Kaelin et al. | 340/793 |
| 3,840,873 | 10/1974 | Usui | 340/815.1 |
| 3,924,227 | 12/1975 | Stolov | 340/702 |
| 4,488,149 | 12/1984 | Givens, Jr. | 340/762 |

FOREIGN PATENT DOCUMENTS

| | | | |
|---|---|---|---|
| 3037500 | 4/1981 | Fed. Rep. of Germany | 340/701 |
| 3009416 | 9/1981 | Fed. Rep. of Germany | 340/762 |
| 0220844 | 4/1985 | German Democratic Rep. | 340/701 |
| 2158631 | 11/1985 | United Kingdom | 340/701 |

OTHER PUBLICATIONS

IBM Technical Disclosure Bulletin, "Electroluminescent Display", R. W. Landauer, vol. 8, No. 11, Apr., 1966.

Bill Wagner, 2-Color LED+Driver=Versatile Visual Effects, Oct. 20, 1980, EDN vol. 25, No. 19.

*Primary Examiner*—Gerald L. Brigance

[57] ABSTRACT

A variable color display device comprises a plurality of display areas arranged in a 7-segment font. Each display area includes at least two light emitting diodes for emitting upon activation light signals of respectively different primary colors and means for blending the light signals within the display area to obtain a composite light signal of a composite color. The light emitting diodes are selectively activated by pulses of substantially constant amplitude to display desired characters. Color control selectively controls the durations of the pulses to control the portions of the primary colors, to thereby control the color of the composite light signal.

8 Claims, 10 Drawing Sheets

CONTINUOUSLY VARIABLE COLOR DISPLAY DEVICE

CROSS-REFERENCE TO RELATED APPLICATIONS

This is a division of my copending application Ser. No. 6/817,114, filed on Jan. 8, 1986, entitled Variable Color Digital Timepiece, now U.S. Pat. No. 4,647,217, issued on Mar. 3, 1987.

BACKGROUND OF THE INVENTION

1. Field of the Invention

This invention relates to variable color display devices in which color of the display may be controlled substantially continuously.

2. Description of the Prior Art

A display device that can change color and selectively display characters is described in my U.S. Pat. No. 4,086,514, entitled Variable Color Display Device and issued on Apr. 25, 1978. This display device includes display areas arranged in a suitable font, such as well known 7-segment font, which may be selectively energized in groups to display all known characters. Each display area includes three light emitting diodes for emitting light signals of respectively different primary colors, which are blended within the display area to form a composite light signal. The color of the composite light signal can be controlled by selectively varying the portions of the primary light signals.

SUMMARY OF THE INVENTION

It is the principal object of this invention to provide a variable color display device in which the color of the display may be controlled substantially continuously.

In summary, each display area of a variable color display device of the invention includes at least two light sources for emitting upon activation light signals of respectively different primary colors which are combined therein to obtain a composite light signal of a composite color. At least a first and second primary color buses are provided to which the light sources in the display areas for emitting light signals of a first and second primary colors are respectively commonly coupled. Data representing colors of the display areas are stored at assigned locations in a memory. Color control circuits repeatedly activate the primary color buses for selective time periods, in accordance with data stored in the memory, to illuminate the display areas in a desired color.

BRIEF DESCRIPTION OF THE DRAWINGS

In the drawings in which are shown several possible embodiments of the invention.

Throughout the drawings, like characters indicate like parts.

DESCRIPTION OF THE PREFERRED EMBODIMENTS

Figure 1:
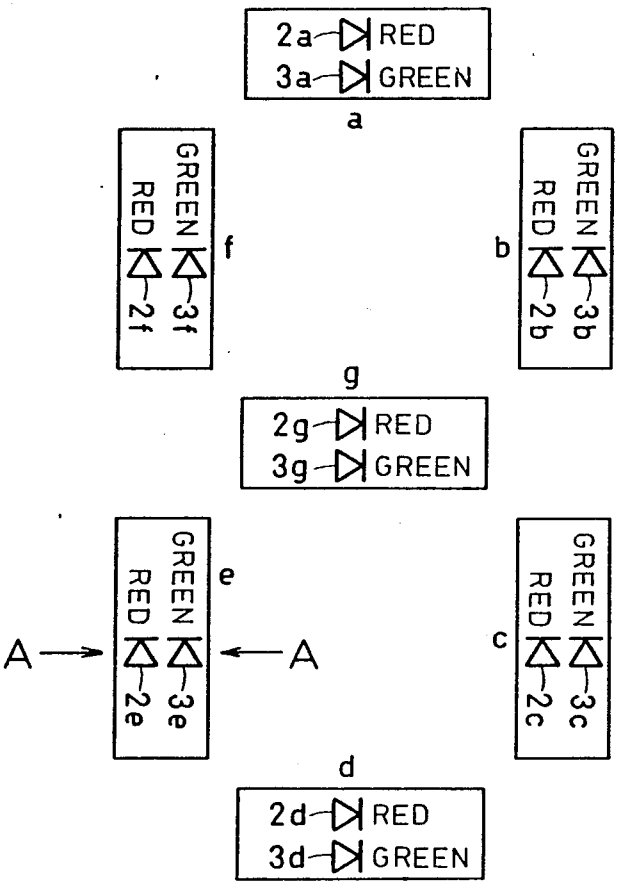
FIG. 1 is an enlarged detail of one digit of 2-primary color digital display.

Referring now, more particularly, to the drawings, in FIG. 1 is shown a 2-primary color display element including seven elongated display segments a, b, c, d, e, f, g, arranged in a conventional pattern, which may be selectively energized in different combinations to display desired digits. Each display segment includes a pair of LEDs (light emitting diodes): a red LED 2 and green LED 3, which are closely adjacent such that the light signals emitted therefrom are substantially superimposed upon each other to mix the colors. To facilitate the illustration, the LEDs are designated by segment symbols, e.g., the red LED in the segment a is designated as 2*a*, etc.

Figure 2:
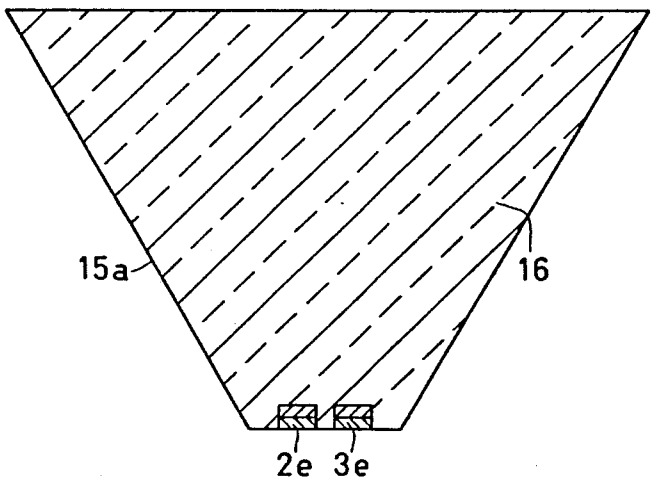
FIG. 2 is an enlarged cross-sectional view of one display segment in FIG. 1, taken along the line A—A.

In FIG. 2, red LED 2*e* and green LED 3*e* are placed on the base of the segment body 15*a* which is filled with transparent light scattering material 16. When forwardly biased, the LEDs 2*e* and 3*e* emit light signals of red and green colors, respectively, which are scattered within the transparent material 16, thereby blending the red and green light signals into a composite light signal that emerges at the upper surface of the segment body 15*a*. The color of the composite light signal may be controlled by varying portions of the red and green light signals.

Figure 3:
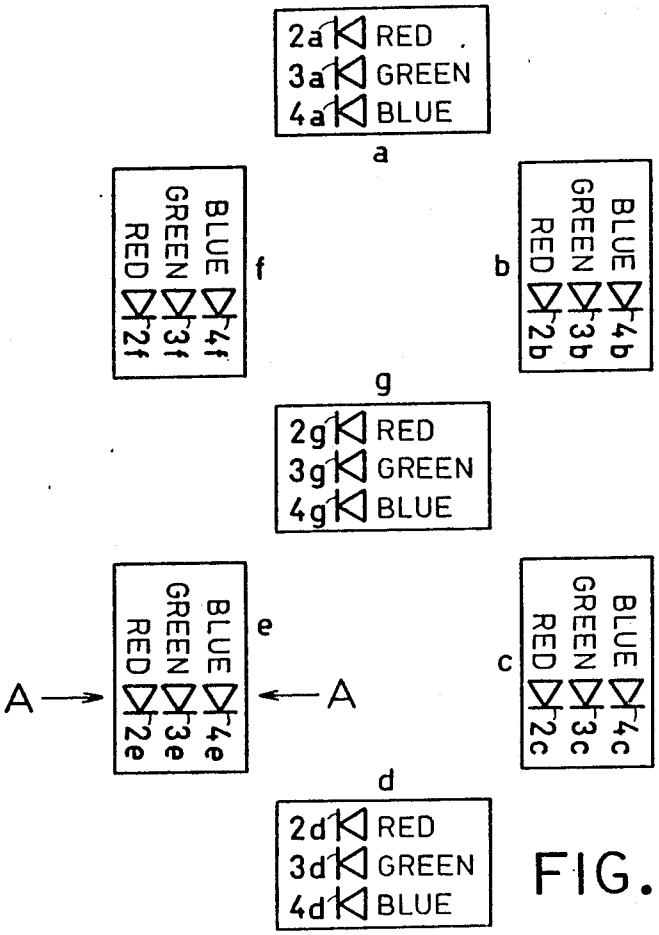
FIG. 3 is an enlarged detail of one digit of 3-primary color digital display.
Figure 4:
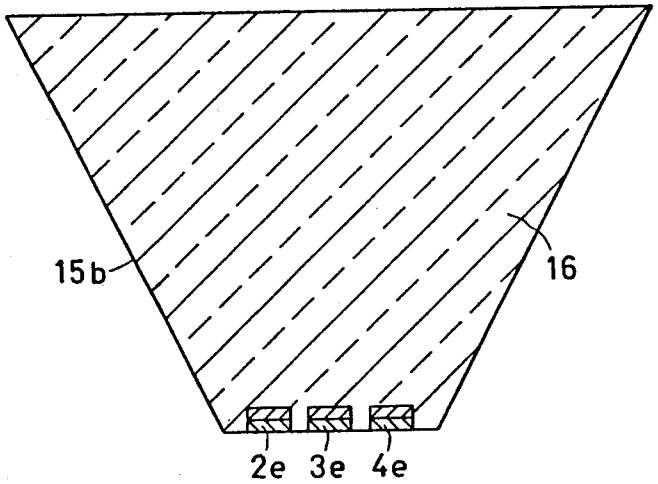
FIG. 4 is an enlarged cross-sectional view of one display segment in FIG. 3, taken along the line A—A.

In FIG. 3, each display segment of the 3-primary color display element includes a triad of LEDs: a red LED 2, green LED 3, and blue LED 4, which are closely adjacent such that the light signals emitted therefrom are substantially superimposed upon one another to mix the colors.

4*e* are placed on the base of the segment body 15*b* which is filled with transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

Figure 5:
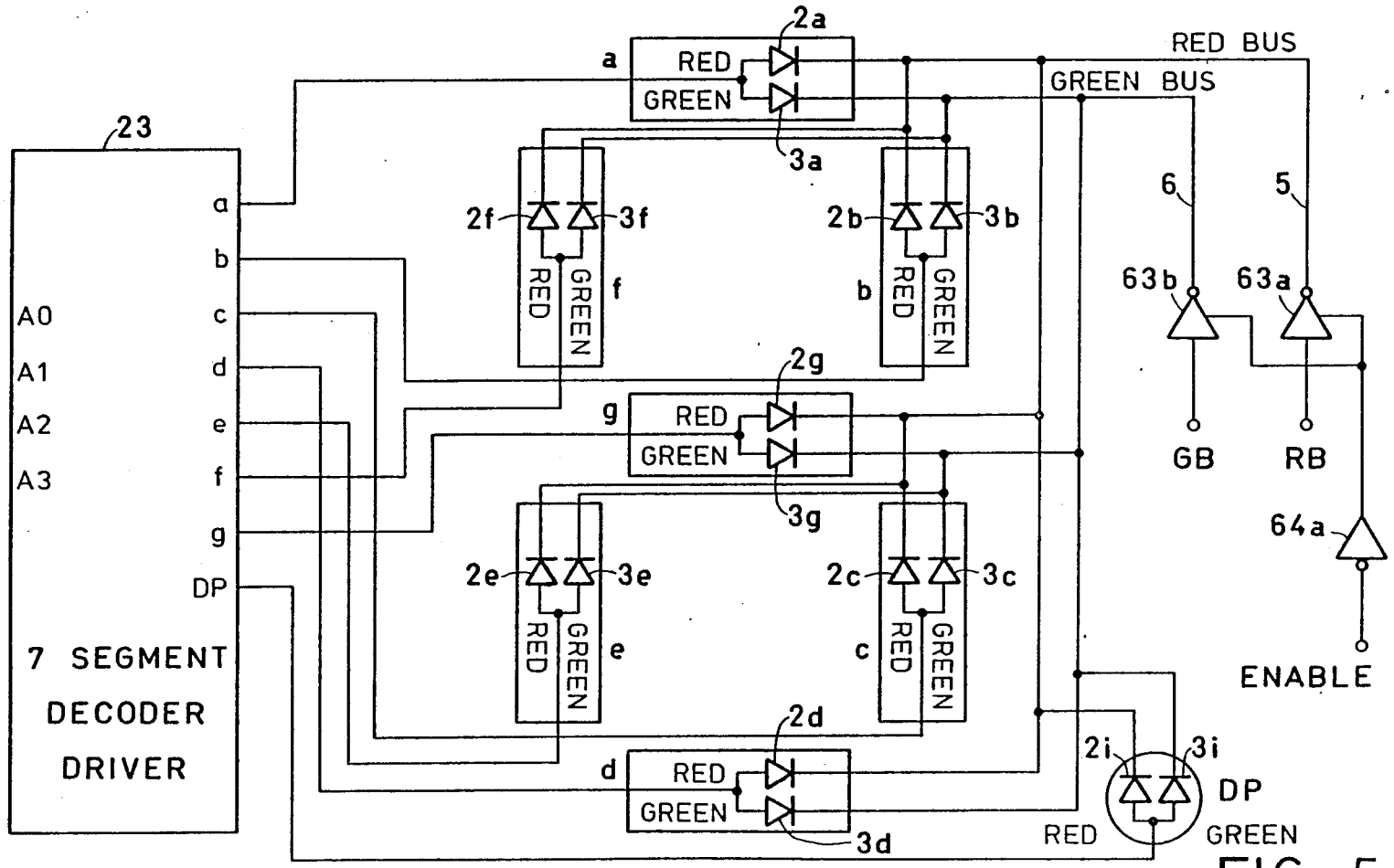
FIG. 5 is a schematic diagram of one digit of 2-primary color control circuit of this invention.

When forwardly biased, the LEDs 2*e*, 3*e*, and 4*e* emit light signals of red, green, and blue colors, respectively, which are scattered within the transparent material 16, thereby blending the red, green, and blue light signals into a composite light signal that emerges at the upper surface of the segment body 15*b*. The color of the composite light signal may be controlled by varying portions of the red, green, and blue light signals. In FIG. 5 is shown a schematic diagram of a one-character 2-primary color common cathodes 7-segment display element which can selectively display various digital fonts in different colors. The anodes of all red and green LED pairs are interconnected in each display segment and are electrically connected to respective outputs of a commercially well known common-cathode 7-segment decoder driver 23. The cathodes of all red LEDs 2*a*, 2*b*, 2*c*, 2*d*, 2*e*, 2*f*, 2*g*, and 2*i* are interconnected to a common electric path referred to as a red bus 5. The cathodes of all green LEDs 3*a*, 3*b*, 3*c*, 3*d*, 3*e*, 3*f*, 3*g*, and 3*i* are interconnected to a like common electric path referred to as a green bus 6.

Figure 6:
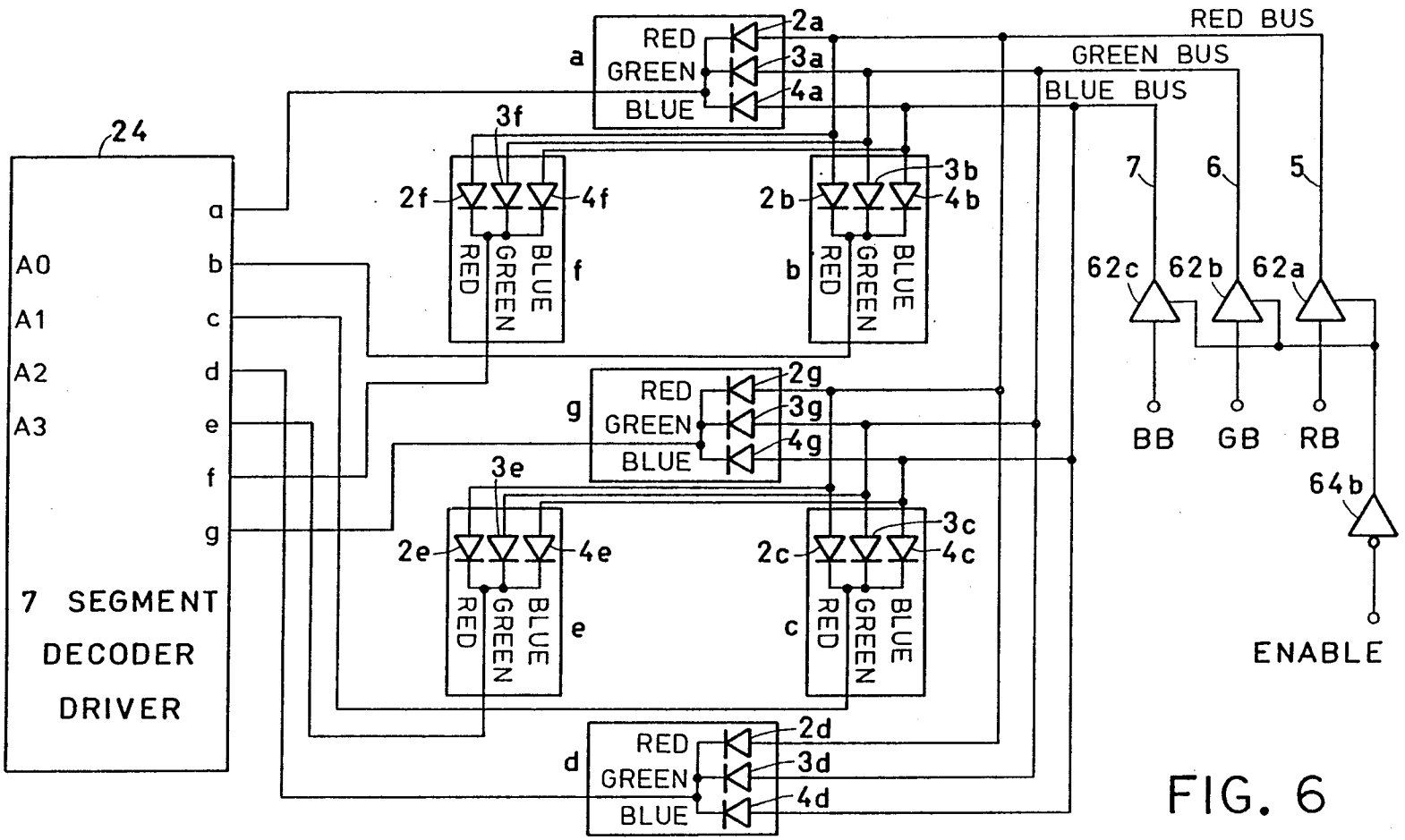
FIG. 6 is a schematic diagram of one digit of 3-primary color control circuit of this invention.

The red bus 5 is connected to the output of a tri-state inverting buffer 63*a*, capable of sinking sufficient current to forwardly bias all red LEDs in the display. The green bus 6 is connected to the output of a like buffer 63*b*. The two buffers 63*a*, 63*b* can be simultaneously enabled by applying a low logic level signal to the input of the inverter 64*a*, and disabled by applying a high logic level signal thereto. When the buffers 63*a*, 63*b* are enabled, the conditions of the red and green buses can be selectively controlled by applying suitable logic control signals to the bus control inputs RB (red bus) and GB (green bus), to illuminate the display in a selected color. When the buffers 63*a*, 63*b* are disabled, both red and green buses are effectively disconnected, and the display is completely extinguished. In FIG. 6 is shown a schematic diagram of a one-character 3-primary color common anodes 7-segment display element which can selectively display digital fonts in different colors. The cathodes of all red, green, and blue LED triads in each display segment are interconnected and electrically connected to respective outputs of a commercially well known common anode 7-segment decoder driver 24. The anodes of all red LEDs 2*a*, 2*b*, 2*c*, 2*d*, 2*e*, 2*f*, 2*g* are interconnected to form a common electric path referred to as a red bus 5. The anodes of all green LEDs 3*a*, 3*b*, 3*c*, 3*d*, 3*e*, 3*f*, 3*g* are interconnected to form a like common electric path referred to as a green bus 6. The anodes of all blue LEDs 4*a*, 4*b*, 4*c*, 4*d*, 4*e*, 4*f*, 4*g* are interconnected to form a like common electric path referred to as a blue bus 7. The red bus 5 is connected to the output of a non-inverting tri-state buffer 62*a*, capable of sourcing sufficient current to illuminate all red LEDs in the display. The green bus 6 is connected to the output of a like buffer 62*b*. The blue bus 7 is connected to the output of a like buffer 62*c*. The three buffers 62*a*, 62*b*, 62*c* can be simultaneously enabled, by applying a low logic level signal to the input of the inverter 64*b*, and disabled by applying a high logic level signal therein. When the buffers 62*a*, 62*b*, 62*c* are enabled, the conditions of the red, green, and blue buses can be selectively controlled by applying suitable logic signals to the bus control inputs RB (red bus), GB (green bus), and BB (blue bus), to illuminate the display in a selected color. When the buffers 62*a*, 62*b*, 62*c* are disabled, all three buses are effectively disconnected, and the display is completely extinguished.

It would be obvious to provide current limiting resistors to constrain current through the LEDs (not shown).

CONTINUOUSLY VARIABLE COLOR CONVERTER

Figure 7:
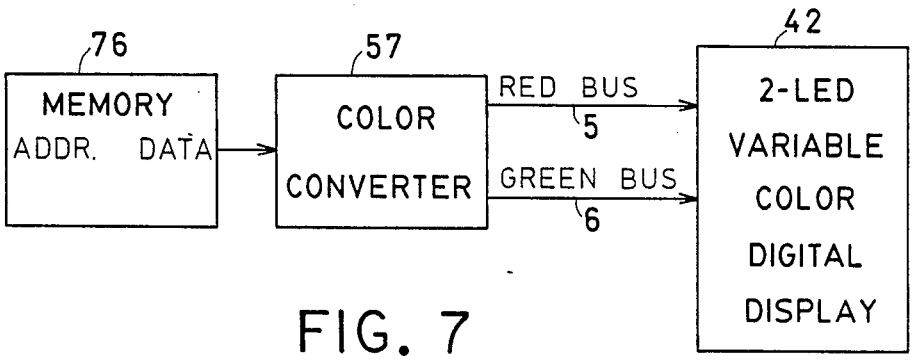
FIG. 7 is an expanded block diagram of a continuously variable color display system utilizing two primary colors.

FIG. 7 is a block diagram of 2-LED continuously variable color display system which includes a memory 76, having a plurality of addressable locations which contain data indicating the portions of red color, and 2-LED color converter circuit 57 for controlling the red bus 5 and green bus 6 of the 2-LED variable color display 42. Means may be provided for selectively addressing the memory locations to extract data therefrom.

Figure 8:
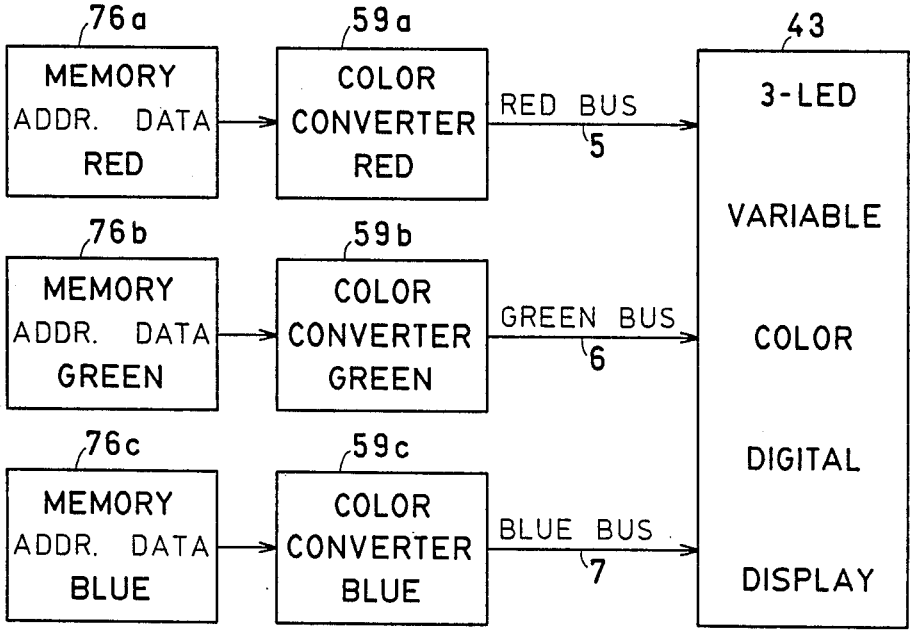
FIG. 8 is an expanded block diagram of a continuously variable color display system utilizing three primary colors.

FIG. 8 is a block diagram of 3-LED continuously variable color display system which differs from the like system shown in FIG. 7 in that a 3-LED color converter circuit 58 is utilized to control the red bus 5, green bus 6, and blue bus 7 of the 3-LED variable color display 43. The display system also includes a memory 76*a*, which contains data indicating the portions of red color, a memory 76*b*, which contains data indicating the portions of green color, and a memory 76*c*, which contains data indicating the portions of blue color. The output data of the memory 76*a* are applied to the red color converter 59*a* which will develop control signals for the red bus 5 of the variable color display 43. The output data of the memory 76*b* are applied to the green color converter 59*b* which will develop control signals for the green bus 6 of the display 43. The output data of the memory 76*c* are applied to the blue color converter 59*c* which will develop control signals for the blue bus 7 of the display 43.

Figure 9:
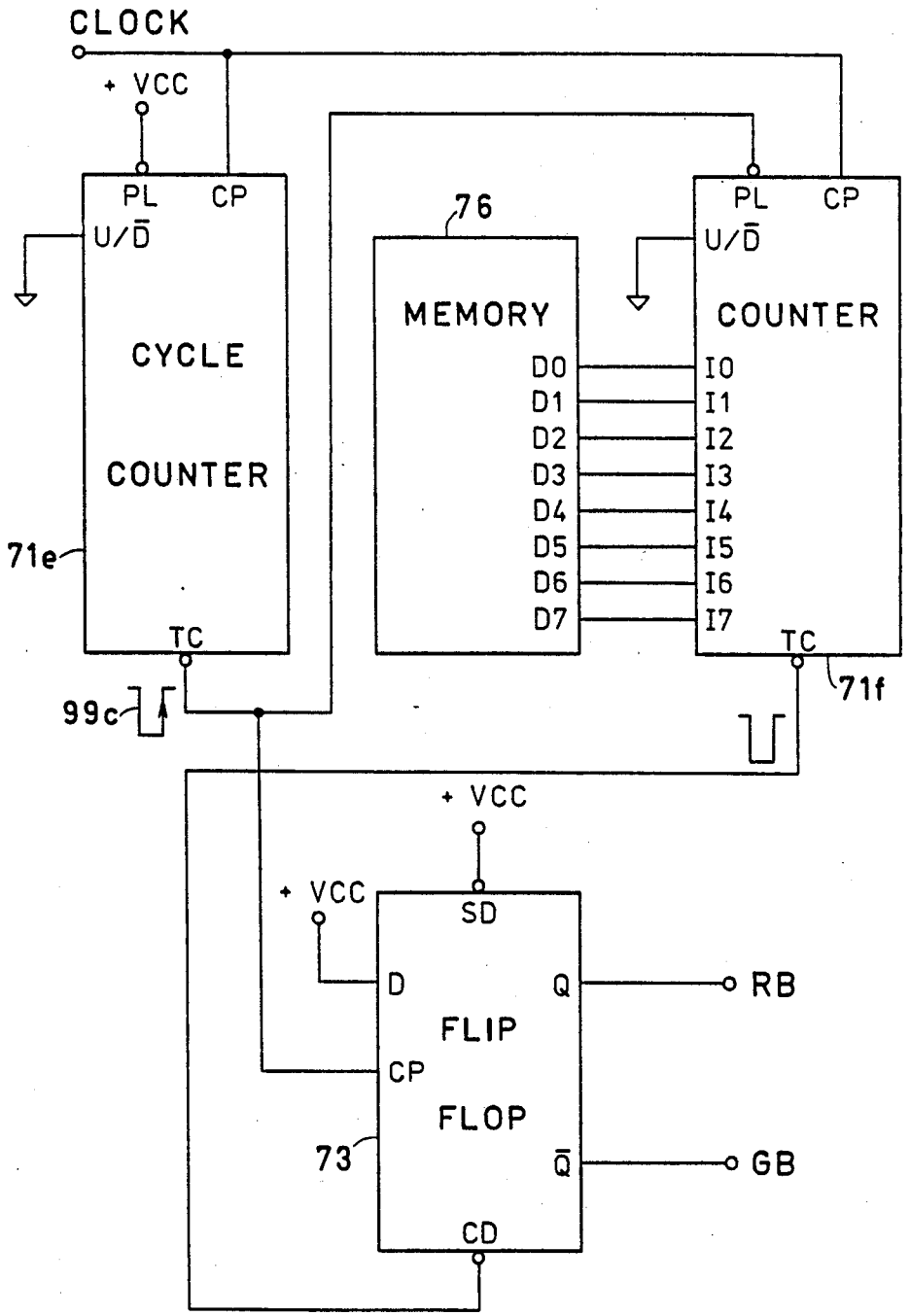
FIG. 9 is a schematic diagram of a memory and color converter combination of FIG. 7.
Figure 10:
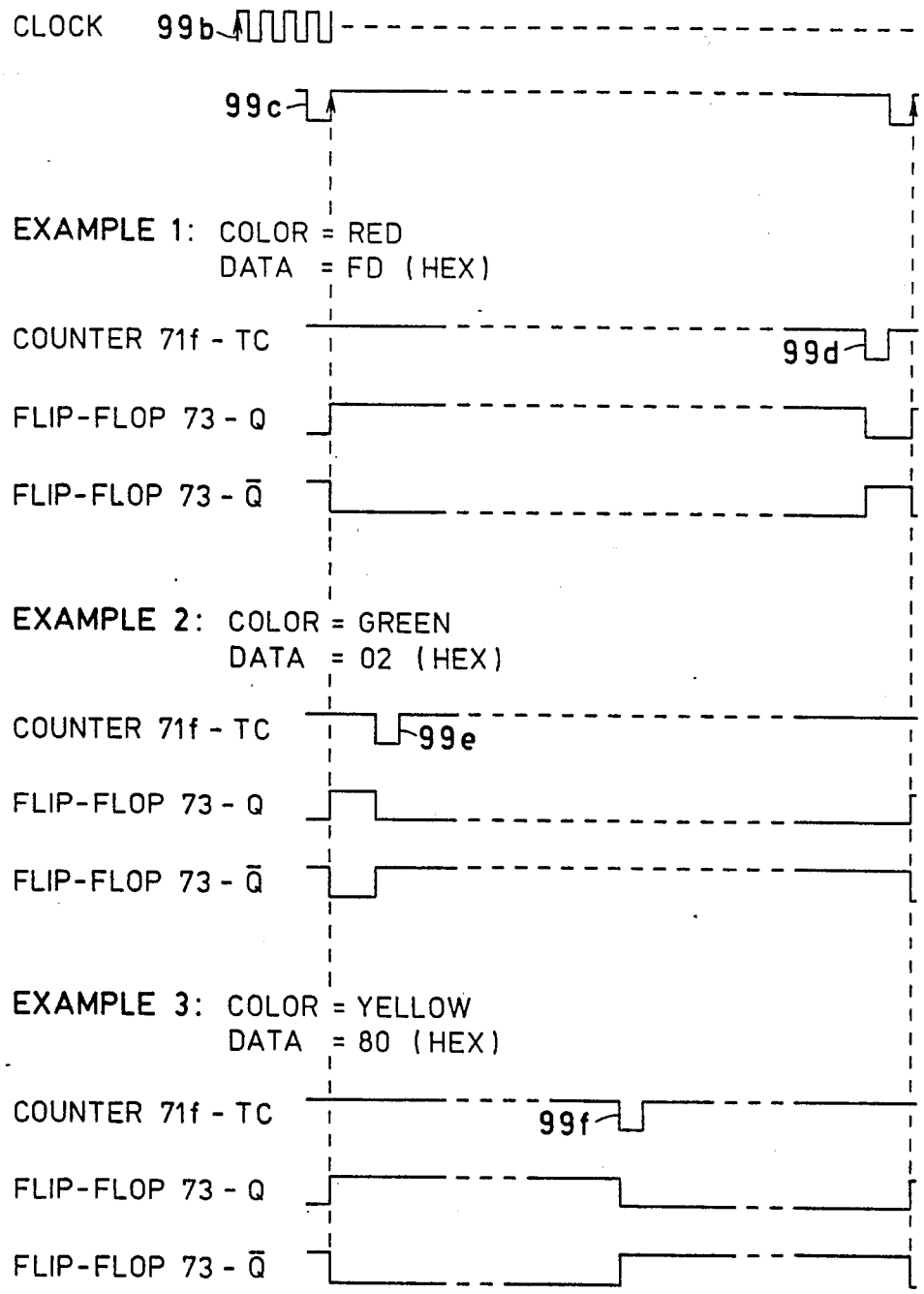
FIG. 10 is a timing diagram of the circuit shown in FIG. 9.

The description of the schematic diagram in FIG. 9 should be considered together with its accompanying timing diagram shown in FIG. 10. A clock signal 99*b* of a suitable frequency (e.g., 10 kHz), to provide a flicker-free display, is applied to the Clock Pulse inputs CP of the 8-bit binary counters 71*e*, 71*f* to step same down. At the end of each counter cycle, which takes 256 clock cycles to complete, the Terminal Count output TC of the counter 71*e* will drop to a low logic level for one clock cycle, to indicate that the lowest count was reached. The negative pulse 99*c* at the TC output of the counter 71*e*, which is connected to the Parallel Load input PL of the counter 71*f*, will cause the instant data at the outputs of the memory 76 to be loaded into the counter 71*f*. The data at the memory represent the portion of red color; the portion of green color is complementary. The rising edge of the TC pulse 99*c* triggers the flip-flop 73 into its set condition wherein its output Q rises to a high logic level.

The counter 71*f* will count down, from the loaded value, until it reaches zero count, at which moment its TC output drops to a low logic level. The negative pulse at the TC output of the counter 71*f*, which is connected to the Clear Direct input CD of the flip-flop 73, causes the latter to be reset and to remain in its reset condition until it is set again at the beginning of the next 256-count cycle. It is thus obvious that the Q output of the flip-flop 73 will be at a high logic level for a period of time proportional to the data initially loaded into the counter 71*f*. The complementary output $\overline{Q}$ will be at a high logic level for a complementary period of time.

The Q and $\overline{Q}$ outputs of the flip-flop 73 are connected to the red bus 5 and green bus 6, repeatedly, via suitable buffers 63*a*, 63*b*, shown in detail in FIG. 5, to energize the buses for variable time periods, depending on the data stored in the memory 76.

By referring again to FIG. 5, when the red bus is energized, by raising its input RB to a high logic level, any digit between 0 and 9 may be selectively displayed in red color by applying appropriate BCD code to the inputs A0, A1, A2, A3 of the common cathode 7-segment decoder driver 23. By way of an example, to display decimal number '7', a BCD code 0111 is applied to the inputs A0, A1, A2, A3. The decoder develops high voltage levels at its outputs a, b, c, to illuminate equally designated segments, and low voltage levels at all remaining outputs, to extinguish all remaining segments. The current flows from the output a of the decoder 23, via red LED 2*a* and red bus 5, to the current sinking output of the buffer 63*a*. Similarly, the current flows from the output b of the decoder 23, via red LED 2*b* and red bus 5, to the output of the buffer 63*a*. The current flows from the output c of the decoder 23, via red LED 2*c* and red bus 5, to the output of the buffer 63*a*. As a result, the segments a, b, c illuminate in red color, thereby causing a visual impression of a character '7'.

To display a number '7' in green color, the green bus must be energized by raising its input GB to a high logic level. The current flows from the output a of the decoder 23, via green LED 3*a* and green bus 6, to the current sinking output of the buffer 63*b*. Similarly, the current flows from the output b of the decoder 23, via green LED 3*b* and green bus 6, to the output of the buffer 63*b*. The current flows from the output c of the decoder 23, via green LED 3*c* and green bus 6, to the output of the buffer 63*b*. As a result, the segments a, b, c illuminate in green color.

By referring now, more particularly, to the timing diagram shown in FIG. 10, in which the waveforms are compressed to facilitate the illustration, the EXAMPLE 1 considers memory data 'FD', in a standard hexadecimal notation, to generate light of substantially red color. At the beginning of the counter cycle, the pulse 99*c* loads the data 'FD' into the counter 71*f*. Simultaneously, the flip-flop 73 is set by the rising edge of the pulse 99*c*. The counter 71*f* will be thereafter stepped down, by clock pulses 99*b*, until it reaches zero count, 2 clock cycles before the end of the counter cycle. At that instant a short negative pulse 99*d* will be produced at its output TC to reset the flip-flop 73, which will remain reset for 2 clock cycles and will be set again by the pulse 99*c* at the beginning of the next counter cycle, which will repeat the process. It is readily apparent that the flip-flop 73 was set for 254 clock cycles, or about 99% of the time, and reset for 2 clock cycles, or about 1% of the time. Accordingly, the red bus 5 of the display 42 will be energized for about 99% of the time, and the green bus 6 will be energized for the remaining about 1% of the time. As a result, the display 42 will illuminate in substantially red color.

The EXAMPLE 2 considers memory data '02' (HEX) to generate light of substantially green color. At the beginning of the counter cycle, the data '02' are loaded into the counter 71*f*, and, simultaneously, the flip-flop 73 is set. The counter 71*f* will count down and will reach zero count after 2 clock cycles. At that instant it will produce at its output TC a negative pulse 99*e* to reset the flip-flop 73. It is readily apparent that the flip-flop 73 was set for 2 clock cycles, or about 1% of the time, and reset for 254 clock cycles, or about 99% of the time. Accordingly, the red bus 5 of the display 42 will be energized for about 1% of the time, and the green bus 6 will be energized for the remaining about 99% of the time. As a result, the display 42 will illuminate in substantially green color.

Figure 11:
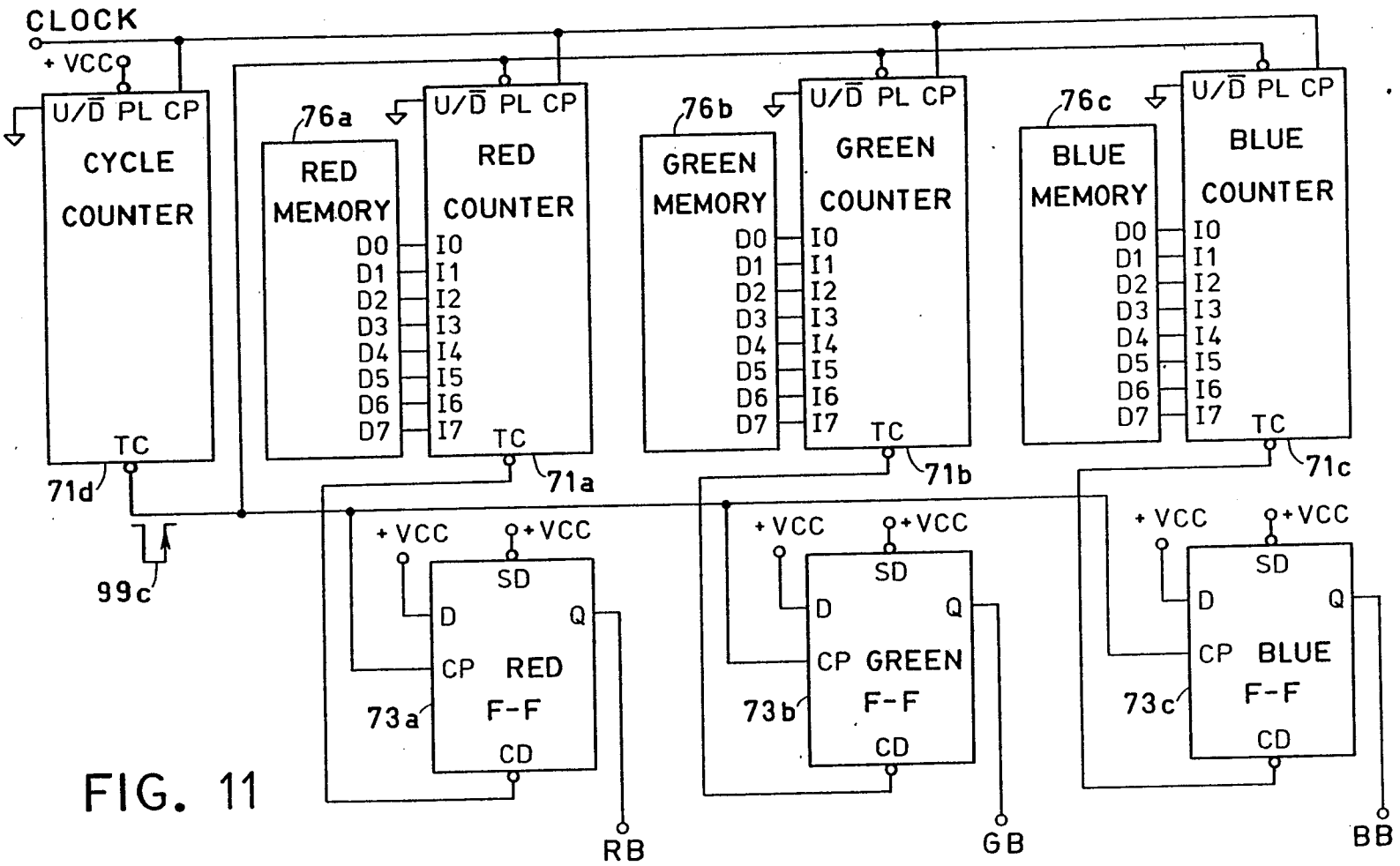
FIG. 11 is a schematic diagram of a memory and color converter combination of FIG. 8.

The EXAMPLE 3 considers memory data '80' (HEX) to generate light of substantially yellow color. At the beginning of the counter cycle, the data '80' are loaded into the counter 71*f*, and, simultaneously, the flip-flop 73 is set. The counter 71*f* will count down and will reach zero count after 128 clock cycles. At that instant it will produce at its output TC a negative pulse 99*f* to reset the flip-flop 73. It is readily apparent that the flip-flop 73 was set for 128 clock cycles, or about 50% of the time, and reset for 128 clock cycles, or about 50% of the time. Accordingly, the red bus 5 of the display 42 will be energized for about 50% of the time, and the green bus 6 will be energized for the remaining about 50% of the time. As a result of blending substantially equal portions of red and green colors, the display 42 will illuminate in substantially yellow color. The description of the schematic diagram of a 3-LED color converter in FIG. 11 should be taken together with its accompanying timing diagrams shown in FIGS. 12 and 13. A clock signal 99*b* is applied to the CP inputs of the counters 71*d*, 71*a*, 71*b*, 71*c*, to step same down. Every 256 counts a negative pulse 99*c* is generated at the TC output of the counter 71*d*, to load data into the counters 71*a*, 71*b*, 71*c* from respective memories 76*a*, 76*b*, 76*c* and to set the flip-flops 73*a*, 73*b*, 73*c*. The data in the red memory 76*a* represent the portions of red color, the data in the green memory 76*b* represent the portions of green color, and the data in the blue memory 76*c* represent the portions of blue color to be blended.

The counters 71*a*, 71*b*, 71*c* will count down, from the respective loaded values, until zero counts are reached. When the respective values of the loaded data are different, the length of time of the count-down will be different for each counter. When a particular counter reaches zero count, its TC output momentarily drops to a low logic level, to reset its associated flip-flop (the red counter 71*a* resets its red flip-flop 73*a*, etc.). Eventually, all three flip-flops 73*a*, 73*b*, 73*c* will be reset. The Q outputs of the flip-flops 73*a*, 73*b*, 73*c* are connected to the red bus 5, green bus 6, and blue bus 7, respectively, via suitable buffers 62*a*, 62*b*, 62*c*, as shown in FIG. 6, to energize the buses for variable periods of time.

By referring again to FIG. 5, when the red bus is energized, by raising its input RB to a high logic level, any digit between 0 and 9 may be selectively displayed in red color by applying appropriate BCD code to the inputs A0, A1, A2, A3 of the common anode 7-segment decoder driver 24. By way of an example, to display decimal number '1', a BCD code 0001 is applied to the inputs A0, A1, A2, A3. The decoder develops low logic levels at its outputs b, c, to illuminate equally designated segments, and high logic levels at all remaining outputs, to extinguish all remaining segments. The current flows from the output of the buffer 62*a*, via red bus 5 and red LED 2*b*, to the output b of the decoder 24, and, via red LED 2*c*, to the output c of the decoder 24. As a result, the segments b, c illuminate in red color, thereby causing a visual impression of a character '1'.

To display a number '1' in green color, the green bus must be energized by raising its input GB to a high logic level. The current flows from the output of the buffer 62*b*, via green bus 6 and green LED 3*b*, to the output b of the decoder 24, and, via green LED 3*c*, to the output c of the decoder 24. As a result, the segments b, c illuminate in green color.

To display a number '1' in blue color, the blue bus must be energized by raising its input BB to a high logic level. The current flows from the output of the buffer 62*c*, via blue bus 7 and blue LED 4*b*, to the output b of the decoder 24, and, via blue LED 4*c*, to the output c of the decoder 24. As a result, the segments b, c illuminate in blue color.

To display characters in a composite color, the red, green, and blue buses may be repeatedly energized for selective time periods, at a relatively fast rate, as will be more fully explained subsequently.

Figure 12:
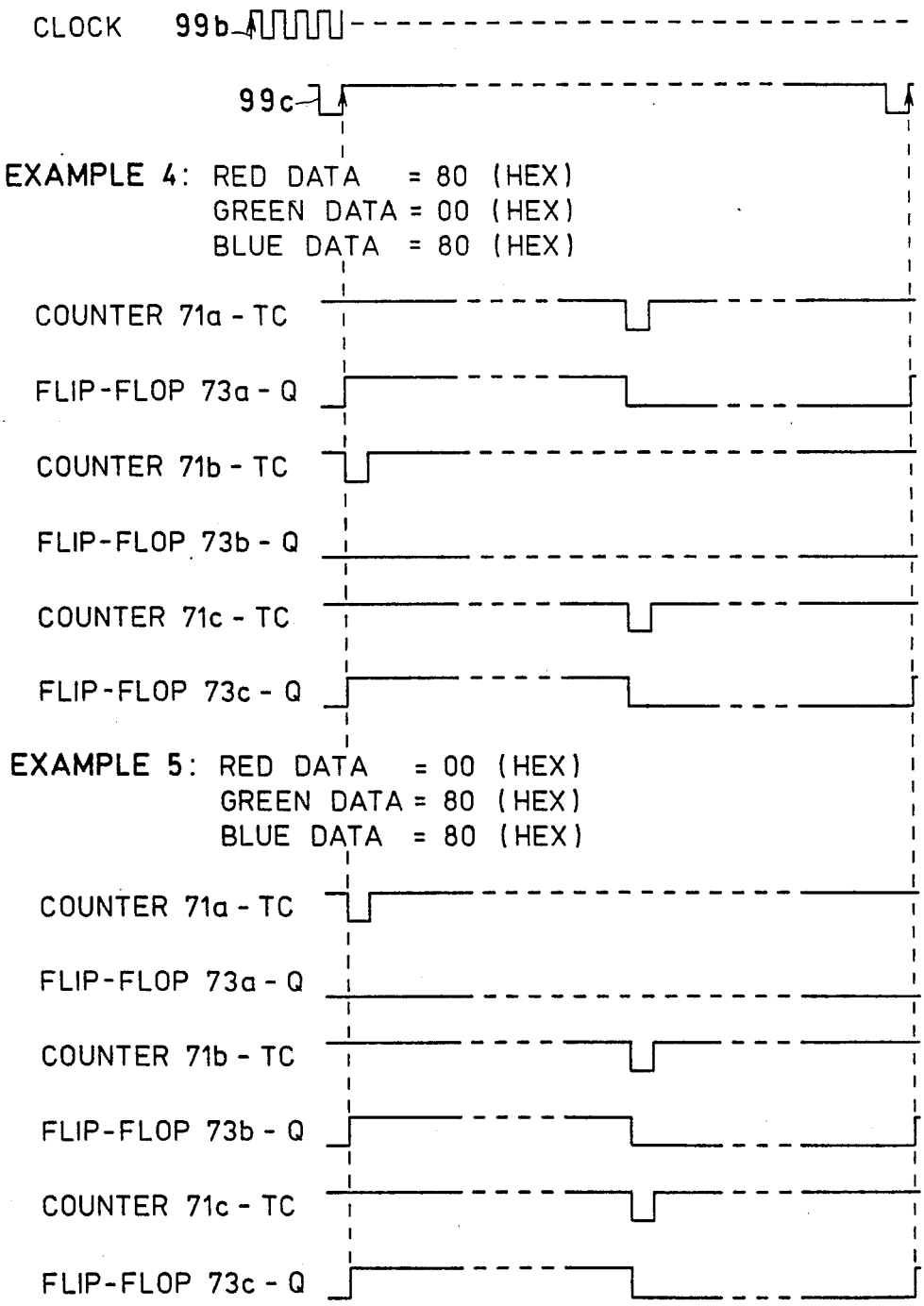
FIG. 12 is a timing diagram of the circuit shown in FIG. 11.
Figure 13:
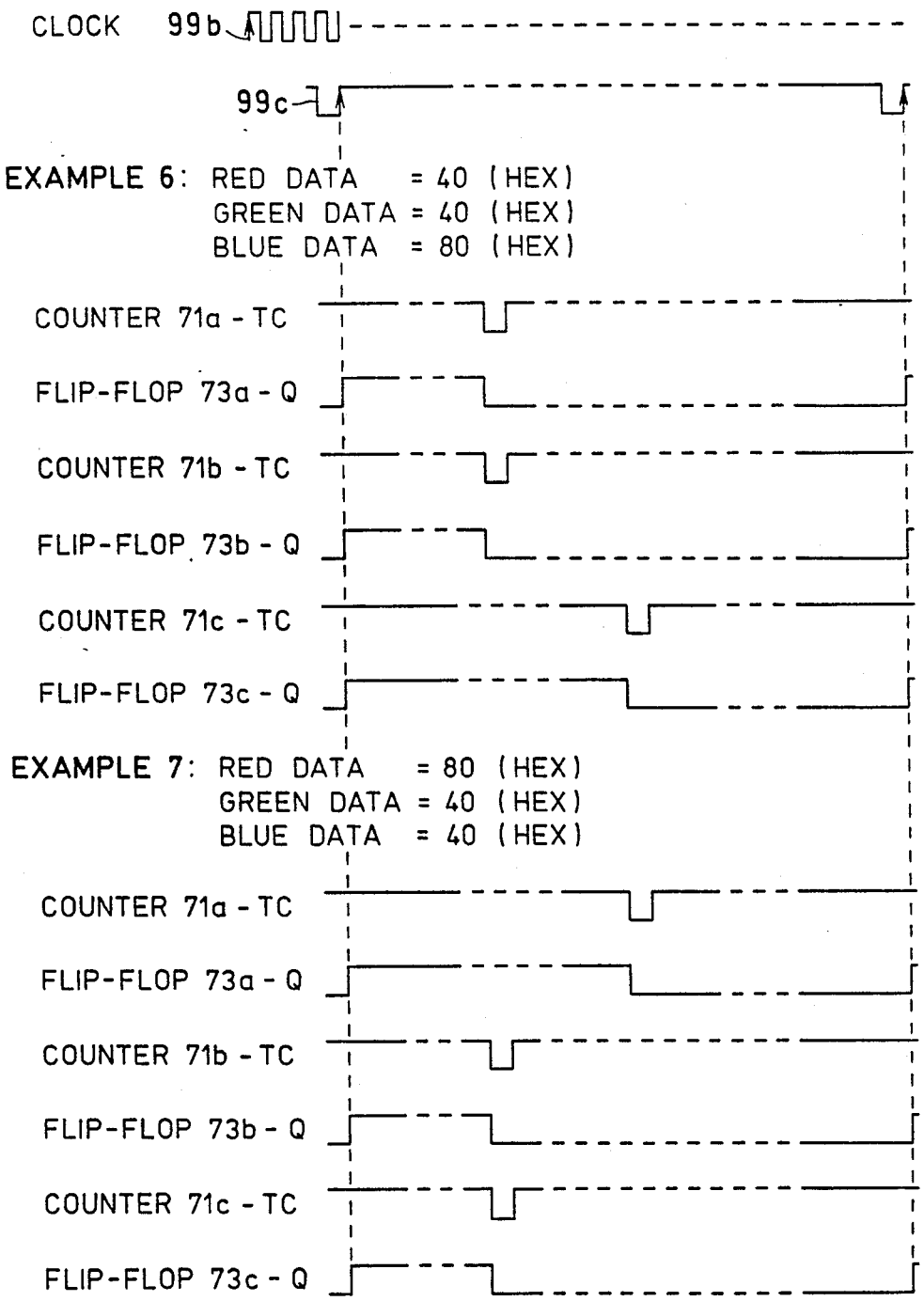
FIG. 13 is a continuation of the timing diagram of FIG. 12.

By referring now more particularly to the timing diagram shown in FIGS. 12 and 13, the EXAMPLE 4 considers red memory data '80', green memory data '00', and blue memory data '80', all in hexadecimal notation, to generate light of substantially purple color. At the beginning of the counter cycle, the pulse 99*c* simultaneously loads the data '80' from the red memory 76*a* into the red counter 71*a*, data '00' from the green memory 76*b* into the green counter 71*b*, and data '80' from the blue memory 76*c* into the blue counter 71*c*. The counters 71*a*, 71*b*, 71*c* will be thereafter stepped down. The red counter 71*a* will reach its zero count after 128 clock cycles; the green counter 71*b* will reach its zero count immediately; the blue counter 71*c* will reach its zero count after 128 clock cycles.

It is readily apparent that the red flip-flop 73*a* was set for 128 clock cycles, or about 50% of the time, the green flip-flop 73*b* was never set, and the blue flip-flop 73*c* was set for 128 clock cycles, or about 50% of the time. Accordingly, the red bus 5 of the display 43 will be energized for about 50% of the time, green bus 6 will never be energized, and blue bus 7 will be energized for about 50% of the time. As a result of blending substantially equal portions of red and blue colors, the display 43 will illuminate in substantially purple color.

The EXAMPLE 5 considers red memory data '00', green memory data '80', and blue memory data '80', to generate light of substantially blue-green color. At the beginning of the counter cycle, the data '00' are loaded into the red counter 71*a*, data '80' are loaded into the green counter 71*b*, and data '80' are loaded into the blue counter 71*c*. The red counter 71*a* will reach its zero count immediately, the green counter 71*b* will reach its zero count after 128 clock cycles, and so will the blue counter 71*c*.

The red flip-flop 73*a* was never set, the green flip-flop 73*b* was set for 128 clock cycles, or about 50% of the time, and so was the blue flip-flop 73*c*. Accordingly, the green bus 5 of the display 43 will be energized for about 50% of the time, and so will be the blue bus. As a result, the display 43 will illuminate in substantially blue-green color.

The EXAMPLE 6 considers red memory data '40', green memory data '40', and blue memory data '80', to generate light of substantially cyan color. At the beginning of the counter cycle, the data '40' are loaded into the red counter 71*a*, data '40' are loaded into the green counter 71*b*, and data '80' are loaded into the blue counter 71*c*. The red counter 71*a* will reach its zero count after 64 clock cycles, and so will the green counter 71*b*. The blue counter 71*c* will reach its zero count after 128 clock cycles.

The red flip-flop 73*a* was set for 64 clock cycles, or about 25% of the time, and so was the green flip-flop 73*b*. The blue flip-flop 73*c* was set for 128 clock cycles, or about 50% of the time. Accordingly, the red bus 5 and green bus 6 of the display 43 will be energized for about 25% of the time, and the blue bus 7 will be energized for about 50% of the time. As a result of blending about 50% of blue color, 25% of red color, and 25% of green color, the display 43 will illuminate in substantially cyan color.

The EXAMPLE 7 considers red memory data '80', green memory data '40', and blue memory data '40', to generate light of substantially magenta color. At the beginning of the counter cycle, the data '80' are loaded into the red counter 71*a*, data '40' are loaded into the green counter 71*b*, and data '40' are loaded into the blue counter 71*c*. The red counter 71*a* will reach its zero count after 128 clock cycles, the green counter 71*b* will reach its zero count after 64 clock cycles, and so will the blue counter 71*c*.

The red flip-flop 73*a* was set for 128 clock cycles, or about 50% of the time, the green flip-flop 73*b* and blue flip-flop 73*c* were set for 64 clock cycles, or about 25% of the time. Accordingly, the red bus 5 of the display 43 will be energized for about 50% of the time, green bus 6 and blue bus 7 will be energized for about 25% of the time. As a result, the display 43 will illuminate in substantially magenta color.

The data values stored in the red, green, and blue memories may be so designed that the sums of the red data, green data, and blue data are constant for all memory addresses, to provide uniform light intensities for all colors. Alternatively, data stored in the red, green, and blue memories may be modified in order to compensate for different efficiencies of red, green, and blue LEDs. By way of an example, data values for a low efficiency LED may be proportionally incremented such that time of energization is proportionally increased, to effectively provide equal luminances for LEDs of unequal efficiencies.

The invention may be now briefly summarized. A variable color display device was disclosed comprising a plurality of variable color display areas arranged in a pattern and adapted to be illuminated in groups in a selected color to selectively exhibit a plurality of display units. Each display area includes a plurality of light sources for emitting upon activation light signals of respectively different primary colors and means for combining the light signals in each display area to obtain a composite light signal of a composite color. A first primary color bus is provided to which the light sources in the display areas for emitting light signals of a first primary color are commonly coupled. At least a second primary color bus is provided to which the light sources in the display areas for emitting light signals of a second primary color are commonly coupled. Data representing portions of the primary colors are stored at assigned locations in a memory. Color control circuits repeatedly activate the primary color buses for selective time periods, in accordance with data stored in the memory, to illuminate the display areas in a desired color. The color control circuits include counters for repetitively extracting data from the memories as counting values, for decrementing the counting values, and for developing control signals when a predetermined counting value is reached. The primary color buses are activated for time periods starting when the data are extracted and ending when respective control signals occur.

All matter herein described and illustrated in the accompanying drawings should be interpreted as illustrative and not in a limiting sense. It would be obvious that numerous modifications can be made in the construction of the preferred embodiments shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 2 | red LED | |
| 3 | green LED | |
| 4 | blue LED | |
| 5 | red bus | |
| 6 | green bus | |
| 7 | blue bus | |
| 15 | segment body | |
| 16 | light scattering material | |
| 23 | common cathode 7-segment decoder | 74LS49 |
| 24 | common anode 7-segment decoder | 74LS47 |
| 42 | variable color 7-segment display (2 LEDs) | |
| 43 | variable color 7-segment display (3 LEDs) | |
| 57 | 2-primary color converter | |
| 58 | 3-primary color converter | |
| 59 | single color converter | |
| 62 | non-inverting buffer | 74LS244 |
| 63 | inverting buffer | 74LS240 |
| 64 | inverter | part of 74LS240,4 |
| 71 | 8-bit counter | 74F579 |
| 73 | D type flip-flop | 74HC74 |
| 76 | memory | |
| 99 | pulse | |

What I claim is:

1. A method for controlling a color of a variable color display device which comprises a plurality of display areas arranged in a pattern for selectively exhibiting a plurality of display units, each said display area including a plurality of light sources for emitting upon activation light signals of respectively different primary colors and means for combining said light signals to obtain a composite light signal of a composite color, by exhibiting a selected display unit by repeatedly substantially simultaneously activating the light sources in selected display areas for brief time intervals to cause the light sources to emit light signals of said primary colors, and by selectively controlling the durations of the time intervals of activation of the light sources in the selected display areas to control the portions of the primary color light signals emitted therefrom, to thereby control the color of the exhibited display unit.

2. A variable color display device comprising:

a plurality of variable color display areas arranged in a pattern for selectively exhibiting a plurality of display units, each said display area including a plurality of light sources or emitting upon activation light signals of respectively different primary colors and means for combining said light signals to obtain a composite light signal of a composite color;

means for exhibiting a selected display unit by repeatedly substantially simultaneously activating the light sources in selected display areas by pulses of a substantially constant amplitude for causing the light sources to emit light signals of said primary colors; and color control means for selectively controlling the durations of the pulses applied to the light sources in the selected display areas to control the portions of the primary color light signals emitted therefrom, to thereby control the color of the exhibited display unit.

3. A method of controlling a color of a variable color display device which comprises a plurality of display areas arranged in a pattern for selectively exhibiting a plurality of display units, each said display area including a plurality of light emitting diodes for emitting when forwardly biased light signals of respectively different primary colors and means for combining said light signals to obtain a composite light signal of a composite color, by exhibiting a selected display unit by repeatedly substantially simultaneously forwardly biasing the light emitting diodes in selected display areas for brief time intervals to cause the light emitting diodes to emit light signals of said primary colors, and by selectively controlling the durations of the time intervals of forward biasing of the light emitting diodes in the selected display areas to control the portions of the primary color light signals emitted therefrom, to thereby control the color of the exhibited display unit.

4. A variable color display device comprising:

a plurality of variable color display areas arranged in a pattern for selectively exhibiting a plurality of display units, each said display area including a plurality of light emitting diodes for emitting when forwardly biased light signals of respectively different primary colors and means for combining said light signals to obtain a composite light signal of a composite color;

means for exhibiting a selected display unit by repeatedly substantially simultaneously forwardly biasing said light emitting diodes in selected display areas by pulses of a substantially constant voltage amplitude for causing the light emitting diodes to emit light signals of said primary colors; and color control means for selectively controlling the durations of the pulses applied to the light emitting diodes in the selected display areas to control the portions of the primary color light signals emitted therefrom, to thereby control the color of the exhibited display unit.

5. A variable color display device comprising:

a plurality of variable color display areas arranged in a pattern for selectively exhibiting a plurality of display units, each said display area including a first light source for emitting upon activation light signals of a first color, a second light source for emitting upon activation light signals of a second color, a third light source for emitting upon activation light signals of a third color, and means for combining said light signals of said first color, said second color, and said third color to obtain a composite light signal of a composite color;

means for exhibiting a selected display unit by repeatedly activating first light sources in selected display areas by a first pulse of a substantially constant amplitude for causing the first light sources to emit light signals of said first color, by repeatedly activating second light sources in the selected display areas by a second pulse of a substantially constant amplitude for causing the second light source to emit light signals of said second color, and by repeatedly activating third light sources in the selected display areas by a third pulse of a substantially constant amplitude for causing the third light sources to emit light signals of said third color;

said first pulse, said second pulse, and said third pulse starting substantially simultaneously; and color control means for selectively terminating said first pulse, said second pulse, and said third pulse to control their respective durations, to control the portions of the light signals of said first color, of said second color, and of said third color emitted from the selected display areas, to thereby control the color of the exhibited display unit.

6. A variable color display device comprising:

a plurality of variable color display areas arranged in a pattern for selectively exhibiting a plurality of display units, each said display area including a first light emitting diode for emitting when forwardly biased light signals of a first color, a second light emitting diode for emitting when forwardly biased light signals of a second color, at third light emitting diode for emitting when forwardly biased light signals of a third color, and means for combining said light signals of said first color, said second color, and said third color to obtain a composite light signal of a composite color;

means for exhibiting a selected display unit by repeatedly forwardly biasing first light emitting diodes in selected display areas by a first pulse of a substantially constant voltage amplitude for causing the first light emitting diodes to emit light signals of said first color, by repeatedly forwardly biasing second light emitting diodes in the selected display areas by a second pulse of a substantially constant voltage amplitude for causing the second light emitting diodes to emit light signals o said second color, and by repeatedly forwardly biasing third light emitting diodes in the selected display areas by a third pulse of a substantially constant voltage amplitude for causing the third light emitting diodes to emit light signals of said third color;

said first pulse, said second pulse, and said third pulse starting substantially simultaneously; and color control means for selectively terminating said first pulse, said second pulse, and said third pulse to control their respective durations, to control the portions of the light signals of said first color, of said second color, and of said third color emitted from the selected display areas, to thereby control the color of the exhibited display unit.

7. A variable color display device comprising:

a plurality of variable color display areas arranged in a pattern, each said display area including a first light source for emitting upon activation light signals of a first primary color, a second light source for emitting upon activation light signals of a second primary color, and means for combining said light signals in each said display area to obtain a composite light signal of a composite color;

a decoder for selectively activating groups of said display areas to exhibit one of a plurality of display units;

a first bus to which the first light sources are commonly coupled for enabling, upon activation of said first bus, the first light sources in the display areas activated by said decoder to be illuminated in said first color;

a second bus to which the second light sources are commonly coupled for enabling, upon activation of said second bus, the second light sources in the display areas activated by said decoder to be illuminated in said second color;

means for repeatedly activating said first bus and said second bus by substantially simultaneously applying thereto pulses of a substantially constant amplitude, respectively, for causing the light sources in the display areas activated by said decoder to emit light signals of said primary colors; and color control means for selectively controlling the durations of the pulses respectively applied to said first bus and to said second bus for controlling the portions of said primary colors, to thereby control the color of the exhibited display unit.

8. A variable color display device comprising:

a plurality of variable color display areas arranged in a pattern, each said display area including a first light source for emitting upon activation light signals of a first primary color, a second light source for emitting upon activation light signals of a second primary color, a third light source for emitting upon activation light signals of a third primary color, and means for combining said light signals in each said display area to obtain a composite light signal of a composite color;

a decoder for selectively activating groups of said display areas to exhibit one of a plurality of display units;

a first bus to which the first light sources are commonly coupled for enabling, upon activation of said first bus, the first light sources in the display areas activated by said decoder to be illuminated in said first color;

a second bus to which the second light sources are commonly coupled for enabling, upon activation of said second bus, the second light sources in the display areas activated by said decoder to be illuminated in said second color;

a third bus to which the third light sources are commonly coupled for enabling, upon activation of said third bus, the third light sources in the display areas activated by said decoder to be illuminated in said third color;

means for repeatedly activating said first bus, said second bus, and said third bus by substantially simultaneously applying thereto pulses of a substantially constant amplitude, respectively, for causing the light sources in the display areas activated by said decoder to emit light signals of said primary colors; and color control means for selectively controlling the durations of the pulses respectively applied to said first bus, to said second bus, and to said third bus for controlling the portions of said primary colors, to thereby control the color of the exhibited display unit.

* * * * *